US009164452B2

(12) United States Patent
Odate

(10) Patent No.: US 9,164,452 B2
(45) Date of Patent: Oct. 20, 2015

(54) IMAGE FORMING APPARATUS

(75) Inventor: Takashi Odate, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 1038 days.

(21) Appl. No.: 13/093,373

(22) Filed: Apr. 25, 2011

(65) Prior Publication Data

US 2011/0268460 A1 Nov. 3, 2011

(30) Foreign Application Priority Data

Apr. 30, 2010 (JP) ..... 2010-105721

(51) Int. Cl.
*G03G 15/20* (2006.01)

(52) U.S. Cl.
CPC ..... *G03G 15/2067* (2013.01); *G03G 15/2032* (2013.01); *G03G 15/2039* (2013.01); *G03G 15/2078* (2013.01); *G03G 2215/2035* (2013.01)

(58) Field of Classification Search
CPC ..... G03G 15/2032; G03G 15/2039; G03G 15/2064; G03G 15/2067; G03G 15/2078
USPC ..... 399/33, 69
See application file for complete search history.

(56) References Cited

U.S. PATENT DOCUMENTS

| | | | | |
|---|---|---|---|---|
| 5,768,654 | A * | 6/1998 | Noguchi et al. | 399/69 |
| 2002/0141775 | A1* | 10/2002 | Mitsuoka et al. | 399/69 |
| 2005/0254846 | A1* | 11/2005 | Yura et al. | 399/67 |
| 2006/0088326 | A1* | 4/2006 | Nakayama | 399/69 |

FOREIGN PATENT DOCUMENTS

| | | | | |
|---|---|---|---|---|
| JP | 6-19366 | A | 1/1994 | |
| JP | 2002-214965 | | 7/2002 | |
| JP | 2002-296955 | | 10/2002 | |
| JP | 2005-321511 | | 11/2005 | |
| JP | 2007-57672 | A | 3/2007 | |
| JP | 2007-212868 | | 8/2007 | |
| JP | 2008-191372 | | 8/2008 | |
| JP | 2008191372 | A * | 8/2008 | G03G 15/20 |

OTHER PUBLICATIONS

Japanese Office Action dated Dec. 17, 2013, issued in counterpart Japanese Application No. 2010-105721, and English-language translation thereof.

* cited by examiner

*Primary Examiner* — Benjamin Schmitt
(74) *Attorney, Agent, or Firm* — Fitzpatrick, Cella, Harper & Scinto

(57) ABSTRACT

An image forming apparatus includes a fixing portion for fixing an image formed on a recording material, the fixing portion including an endless belt, a heater contacted to an inner surface of the endless belt, a pressing member for forming a fixing nip with the heater with the endless belt in the nip, and a switching mechanism for switching a state of the fixing nip between a first state in which pressure at the time of a fixing operation is applied in the fixing nip and a second state in which the pressure at the time of the fixing operation is not applied in the fixing nip. When electric power is supplied to the heater in the second state, the switching mechanism operates to switch the state of the fixing nip from the second state to the first state.

2 Claims, 12 Drawing Sheets

(a)

(b)

IMAGE FORMING APPARATUS

FIELD OF THE INVENTION AND RELATED ART

The present invention relates to an image forming apparatus which employs an electrophotographic, electrostatic, magnetic, or the like image forming method.

Some toner image fixing devices mounted in an image forming apparatus have: an endless belt; a heater which is in contact with the inward surface of the endless belt; and a pressing member which forms a fixation nip by being kept pressed against the heater with the presence of the endless belt between the heater and itself. The image fixing apparatuses structured as described above are smaller in thermal capacity, being therefore meritorious in that they have a significantly shorter startup time, that is, they become ready to perform fixation in a significantly shorter time than fixing devices of the types different from the above-described type.

If a fixing apparatus structured as described above is kept unused for a substantial length of time while the pressing member is kept pressed against the heater, the endless belt and pressing member some times deform, making it impossible for the fixing device to satisfactorily fix images. Thus, some image forming apparatuses are provided with a pressure removing means for keeping the fixing device in the state in which the pressing member is not kept pressed against the heater, when the apparatuses are in the sleep mode, their electric power sources are off, or the like situation. Some of the technologies related to this pressure removing means are disclosed in Japanese Laid-open Patent Applications 2005-321511, 2002-214965, and 2002-296955. However, the technologies disclosed in these patent applications suffer from the following problems.

That is, if electric power is supplied to the heater while the endless belt is not pressed upon the heater by the pressing member, the amount of heat transmitted to the endless belt is substantially smaller than that while the endless belt is kept pressed upon the heater by the pressing member. Thus, the heater temperature very quickly increases, making it possible for the components of the fixing device to be thermally damaged.

In comparison, a fixing device such as the fixing device disclosed in Japanese Laid-open Patent Application 2005-32151, is provided with a switching element which blocks the electric power supply to the heater if the pressing member is stopped from pressing on the endless belt upon the heater. Further, the fixing devices disclosed in Japanese Laid-open Patent Applications 2002-214965 and 2002-29695 are provided with a relay which blocks the electric power supply to the heater, and a circuit structured to detect the malfunction of the relay to inform a user of the malfunctions of the relay.

However, in the case of the structural arrangement disclosed in Japanese Laid-open Patent Application 2005-321511, it is liable that if the switching element malfunctions for some reason, electric power is supplied to the heater even though the pressing member is not pressing the endless belt upon the heater. Further, in the case of the structural arrangements disclosed in Japanese Laid-open Patent Applications 2002-214965 and 2002-296955, which make it possible for the relay malfunction to be detected, electric power is supplied to the heating member unless a user notices the relay malfunction and shuts off the electric power supply to the heater. Also in the latter two cases, the fixing devices are not structured to detect the malfunctioning of a triac as an electric power transmission controlling means. Therefore, electric power is supplied to the heater if the triac malfunctions.

That is, the abovementioned documents do not disclose a structural arrangement which takes into consideration the possibility that relays and/or triacs might malfunction, that is, a structural arrangement which prevents the fixing device components and the components related to the fixing device, from being thermally damaged, even if the relay, triac, etc., malfunction.

SUMMARY OF THE INVENTION

Thus, the primary object of the present invention is to provide an image forming apparatus which provides significantly less thermal damage to the fixing device components when electric power is supplied to the heater due to the malfunctioning of circuit elements while there is virtually no pressure in the fixation nip, than any of image forming apparatuses in accordance with the prior art.

According to an aspect of the present invention, there is provided an image forming apparatus comprising a fixing portion for fixing an image formed on a recording material, the fixing portion including an endless belt, a heater contacted to an inner surface of the endless belt, a pressing member for forming a fixing nip with the heater with the endless belt in the nip; and a switching mechanism for switching a state of the fixing nip between a first state in which pressure at the time of a fixing operation is applied in the fixing nip and a second state in which the pressure at the time of the fixing operation is not applied in the fixing nip. When electric power is supplied to the heater in the second state, the switching mechanism operates to switch the state of the fixing nip from the second state to the first state.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

<Embodiment 1>

Figure 1:
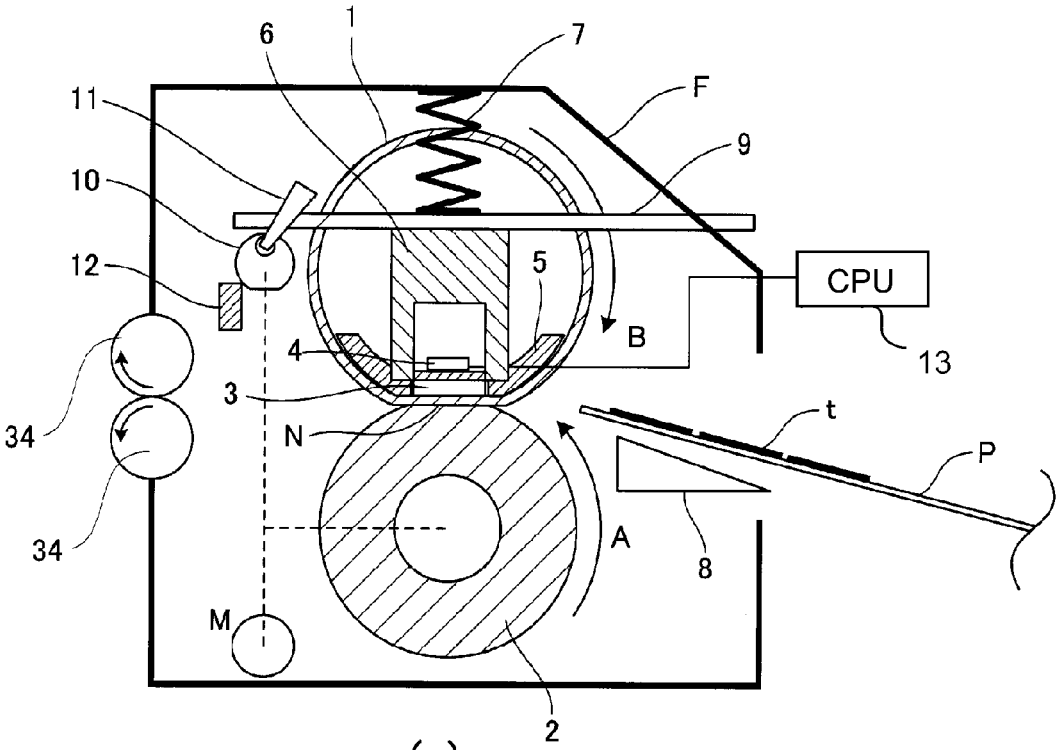
FIG. 1 is a schematic sectional view of the fixing portion in the first preferred embodiment of the present invention, and shows the general structure of the fixing portion.
Figure 1:
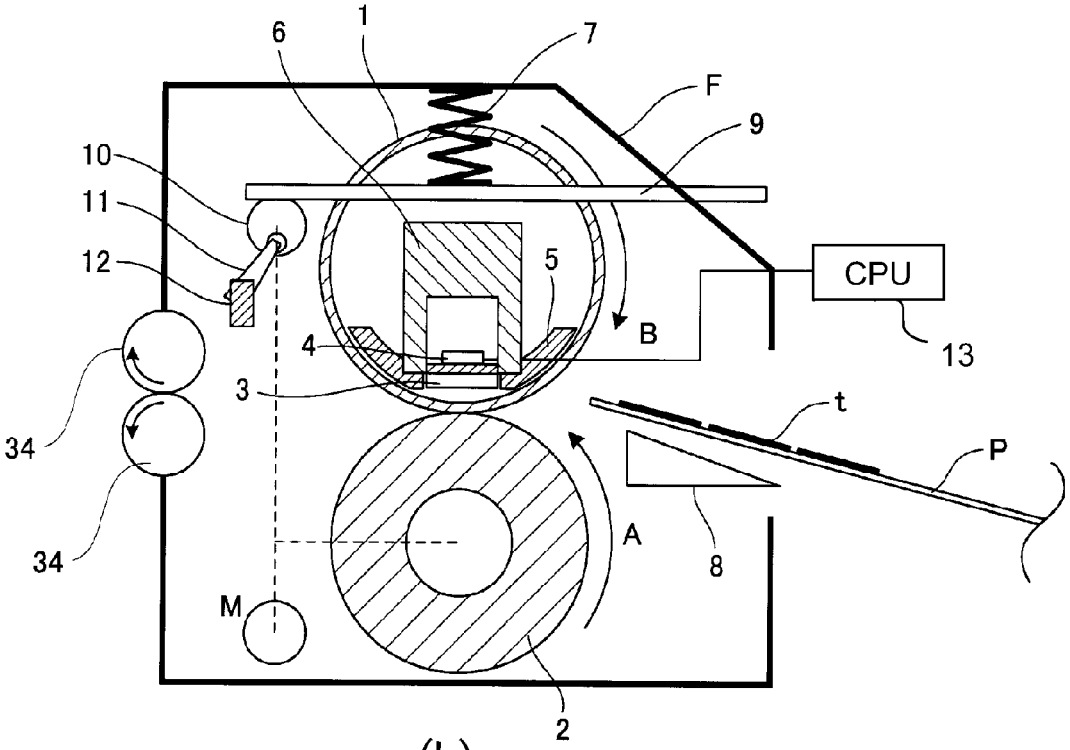

First, referring to FIGS. 1-5, the image forming apparatus in the first preferred embodiment of the present invention is described.

(1-1: General Structure of Image Forming Apparatus)

The image forming apparatus in this embodiment is an electrophotographic image forming apparatus, which is employable by a copying machine, a printer, and the like. The image formation process with which the present invention is compatible is not limited to the electrophotographic process. For example, the present invention is also compatible with an electrostatic recording process, a magnetic recording process, and the like.

The electrophotographic image forming apparatus has a photosensitive drum as an image bearing member. It has also a charging member, an exposing member, a developing member, a transferring member, and a cleaning member, which are in the adjacencies of the peripheral surface of the photosensitive drum.

The image forming operation carried out by the image forming apparatus structured as described above is as follows: First, the peripheral surface of the photosensitive drum is uniformly charged to the polarity which is the same as the normal polarity of the toner. Then, an electrostatic latent image is formed on the peripheral surface of the photosensitive drum by exposing (scanning) the uniformly charged portion of the peripheral surface of the photosensitive drum, with the beam of light projected from the exposing member. Then, toner is supplied to the electrostatic latent image, whereby the electrostatic latent image is developed into an image formed of toner (which hereafter will be referred to simply as toner image). After the formation of the toner image through the above described processes, the toner image is electrostatically transferred onto a sheet of a recording medium, in the nip that is between the peripheral surface of the photosensitive drum and the transferring member, which faces the peripheral surface of the photosensitive drum, while one of the sheets of the recording medium, fed one by one into the main assembly of the image forming apparatus from a sheet feeder tray, is conveyed through the nip. As for the toner particles remaining on the peripheral surface of the photosensitive drum after the transfer, that is, the toner particles which failed to be transferred, they are removed by the cleaning member.

The sheet of the recording medium onto which the toner image has just been transferred is conveyed to a fixing portion (image heating portion) in which heat and pressure is applied to the toner image. Thus, as the sheet of the recording medium on which the toner image is present is conveyed through the fixing portion, the toner image becomes fixed to the sheet of the recording medium. Thereafter, the sheet of the recording medium is conveyed by way of a pair of recording medium conveyance rollers, a pair of discharge rollers, etc., and then, is discharged from the image forming apparatus. This ends the image formation sequence.

(1-2: General Structure of Fixing Portion)

Next, referring to FIGS. 1(*a*) and 1(*b*), the general structure of the fixing portion F in this embodiment is described. FIG. 1(*a*) shows the state of fixing portion F, in which the pressure roller 2 is kept pressed against the ceramic heater 3 with the presence of the fixation sleeve 1 (endless belt) between the pressure roller 2 and heater 3. FIG. 1(*b*) shows the state of the fixing portion F, in which the pressure roller 2 is not kept pressed against the heater 3.

The fixing portion F in this embodiment is made up of the flexible fixation sleeve 1, and a pressure roller 2, which is a pressure applying member. The fixation sleeve 1 and the pressure roller 2 are positioned in such a manner that the outward surface of the fixation sleeve 1 faces the peripheral surface of the pressure roller 2. The fixing portion F has also a heater 3, which is a heating member and is on the inward side of the loop which the fixation sleeve 1 forms. The fixation sleeve 1 and the heater 3 make up a heating portion. The heating portion and pressing member form a fixation nip N, in which the toner image t on a sheet P of the recording medium is subjected to heat and pressure. As the pressure roller 2 is rotated by an unshown pressure roller driving power source, in the direction indicated by an arrow mark A in the drawing, while being kept pressed against the heater 3, the fixation sleeve 1 is moved by the rotational movement of the pressure roller 2, in the direction indicated by an arrow mark B in the drawing. The sheet P of the recording medium is conveyed through the fixation nip N while being guided by a sheet guiding member 8. As the sheet P comes out of the fixation nip N, it is separated from the fixation sleeve 1 by the curvature of the peripheral surface of the fixation sleeve 1 (heater holder) and the curvature of the peripheral surface of the pressure roller 2, and then, is discharged from the fixing portion F by a pair of discharge rollers 34.

The fixation sleeve 1 is made up of: a cylindrical endless film which is made of polyimide resin, and roughly 50 μm in thickness; an elastic layer formed on the endless film, of silicone rubber by a cylinder coating method; and a surface layer formed by covering the elastic layer with a tube made of PFA resin, which is roughly 30 μm in thickness. As for the pressure roller 2, it is made up of: a metallic core made of stainless steel; a silicon rubber layer which is formed in a manner to cover the entirety of the peripheral surface of the metallic core by ejection molding and is roughly 3 mm in thickness; and a surface layer which is made by covering the rubber layer with a PFA tube made of PFA resin. The metallic core of the pressure roller 2 is rotatably supported by the lateral plates (unshown) of the fixing portion F.

The fixing portion F has the ceramic heater 3 as a heat generating member which is on the inward side of the loop of the fixation sleeve 1. The ceramic heater 3 is made of a ceramic substrate, and a heat generating resistor formed on the ceramic substrate. It is structured so that it can be supplied with electric power from a commercial electric power source through its electrical terminals. The amount of electric power supplied to the ceramic heater 3 is controlled by a CPU 13 as a controlling means with which the image forming apparatus is provided. That is, it is controlled so that the temperature of the fixation nip N is kept at a level (target level) which is sufficient for fixation when a toner image is fixed.

The ceramic heater 3 is attached to the bottom surface of a heater holder 5 which is formed of liquid polymer which is superior in heat resistance. It is positioned so that its heat generating surface (surface having heat generating resistor) is kept directly in contact with the inward surface of the fixation sleeve 1. Incidentally, the surface of the ceramic heater 3 may be coated with grease to reduce the friction between the ceramic 3 and the fixation sleeve 1. The fixation sleeve 1 loosely fits around the heater holder 5.

Since the fixing portion F is structured as described above, it is ensured that as the fixation sleeve 1 is circularly moved, its inward surface slides on the ceramic heater 3, and also, that as the fixation sleeve 1 is rotated, it can be guided by the heater holder 5. Further, the fixing portion F is structured so that the ceramic heater 3 and the pressure roller 2 oppose each other with the fixation sleeve 1 remaining sandwiched by the ceramic heater 3 and pressure roller 2. Therefore, it is possible to efficiently transfer the heat generated by the ceramic heater 3, to the sheet P of the recording medium as the sheet P is conveyed through the fixation nip N. The positional relationship among the heater holder 5, the ceramic heater 3, the fixation sleeve 1, and the pressure roller 2 is such that the lengthwise direction of the heater 5, the lengthwise direction of the ceramic heater 3, the lengthwise direction (axial line) of fixation sleeve 1, and the lengthwise direction (axial line) of the pressure roller 2 are roughly parallel to each other.

Figure 2:
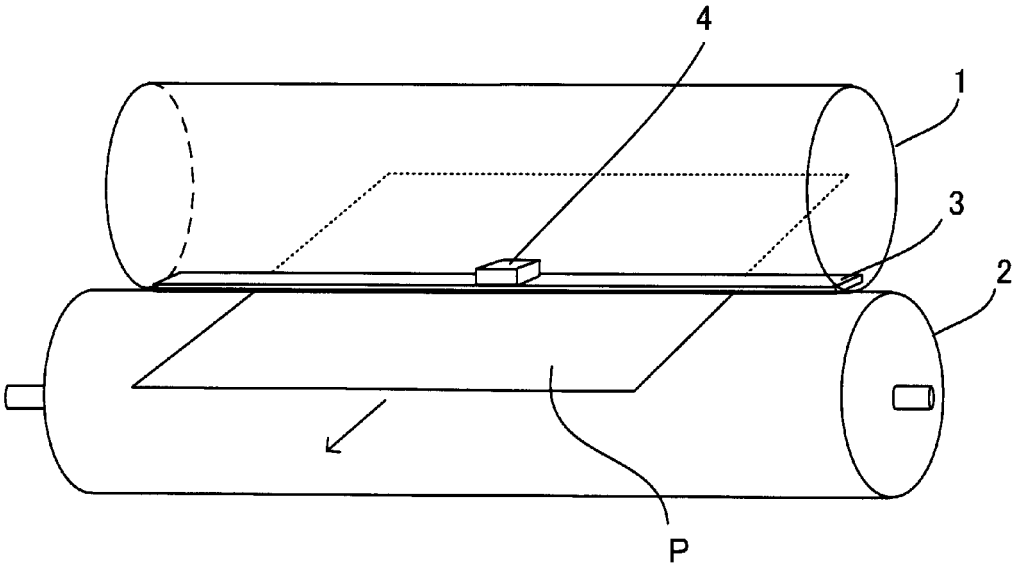
FIG. 2 is a schematic perspective view of the fixing portion of the first preferred embodiment of the present invention, and shows the general structure of the fixing portion.

The fixing portion F is provided with a thermistor 4 (temperature detection element) for detecting the temperature of the ceramic heater 3. FIG. 2 shows the position of the thermistor 4. More specifically, the thermistor 4 is on the rear side (top side) of the ceramic heater 3, and is roughly in the middle of the ceramic heater 3 in terms of the lengthwise direction of the ceramic heater 3. The thermistor 4 is connected to the CPU, whereby the amount of the electric power supplied to the ceramic heater 3 is controlled so that the temperature level detected by the thermistor 4 remains at a target level. Incidentally, the target temperature level set in this embodiment is 195° C. However, it is not mandatory that the target temperature level for fixation is set to 195° C.

Further, the fixing portion F is provided with a pressure application stay 6, which is in contact with the heater holder 5, from the opposite side (top side) from the ceramic heater 3. The pressure application stay 6 is under the pressure applied to its lengthwise end portions by pressure application springs 7 through a pressure plate 9. Thus, the fixation sleeve 1 is kept pressured toward the pressure roller 2, creating thereby the fixation nip N, which is wide enough for proper fixation, in terms of the rotational direction of the fixation sleeve 1. The amount of the pressure applied by the pressure springs 7 is 98 N (10 kgf) per lengthwise end of the pressure plate 9, that is, a total of 196 N (20 kgf).

(1-3: Means for Removing Pressure from Fixing Portion)

The fixing portion F in this embodiment is provided with a pressure removing means which is for switching the state of the fixing portion F from a state (first state) in which the pressure roller 2 is kept pressed against the ceramic heater 3 with the presence of the fixation sleeve 1 between the ceramic heater 3 and the pressure roller 2 by the amount necessary for satisfactory toner image fixation, to another state (second state) in which the pressure roller 2 is not kept pressed against the ceramic heater 3, when the image forming apparatus is in the sleep mode, when the electric power source of the apparatus is off, when jammed recording medium is removed, or in the like situation. More specifically, the fixing portion F is provided with a pressure removing mechanism (mechanism for switching state of fixing portion F) made up of a pressure removing cam 10 for lifting the pressure plate 9 (FIG. 1). The cam 10 is rotated by a motor M.

The procedure for removing the fixation pressure from the fixation nip N is as follows: As the pressure removal cam 10 is rotated by the driving of the motor M, the pressure plate 9 is moved in the opposite direction from the heater 3, whereby the pressure plate 9 is moved upward against the resiliency of the springs 7. Consequently, the pressure plate 9 separates from the stay 6. Thus, the fixation pressure is removed from the fixing portion F. That is, the state of the fixing portion F is switched from the state, shown in FIG. 1(*a*), in which the pressure roller 2 is kept pressed against the heater 3, to the state, shown in FIG. 1(*b*), in which there is no pressure in the fixation nip N. Incidentally, when the fixing portion F is in the pressure-free state (second state, that is, the state in which fixation nip N does not have fixation pressure, the contact pressure between the fixation sleeve 1 and pressure roller 2 is roughly 0 N.

Further, the fixing portion F is provided with a pressure removal detecting means which detects the switching of the state of the fixing portion F to the state in which the pressure roller 2 is not kept pressed against the ceramic heater 3. More concretely, the pressure removal detecting means has: a flag 11 which is on the rotational shaft of the pressure removal cam 10; and a photosensor 12. Thus, as the pressure removal cam 10 is rotated to remove pressure from the fixation nip N, the flag 11 blocks the photosensor from light, informing thereby the CPU 13 of "pressure removal".

As the image forming apparatus is placed in the sleep mode, as the electric power source of the apparatus is turned off, when the jammed recording medium needs to be removed, or in the like situation, the CPU 13 drives the motor M to put the fixing portion F in the state in which the pressure roller 2 is not kept pressed against the ceramic heater 3 with the fixation sleeve 1 between the pressure roller 2 and heater 3. Therefore, the fixation sleeve 1 and/or pressure roller 2 is not deformed during the abovementioned situations.

(1-4: Structure of Electric Power Control Circuit)

Figure 3:
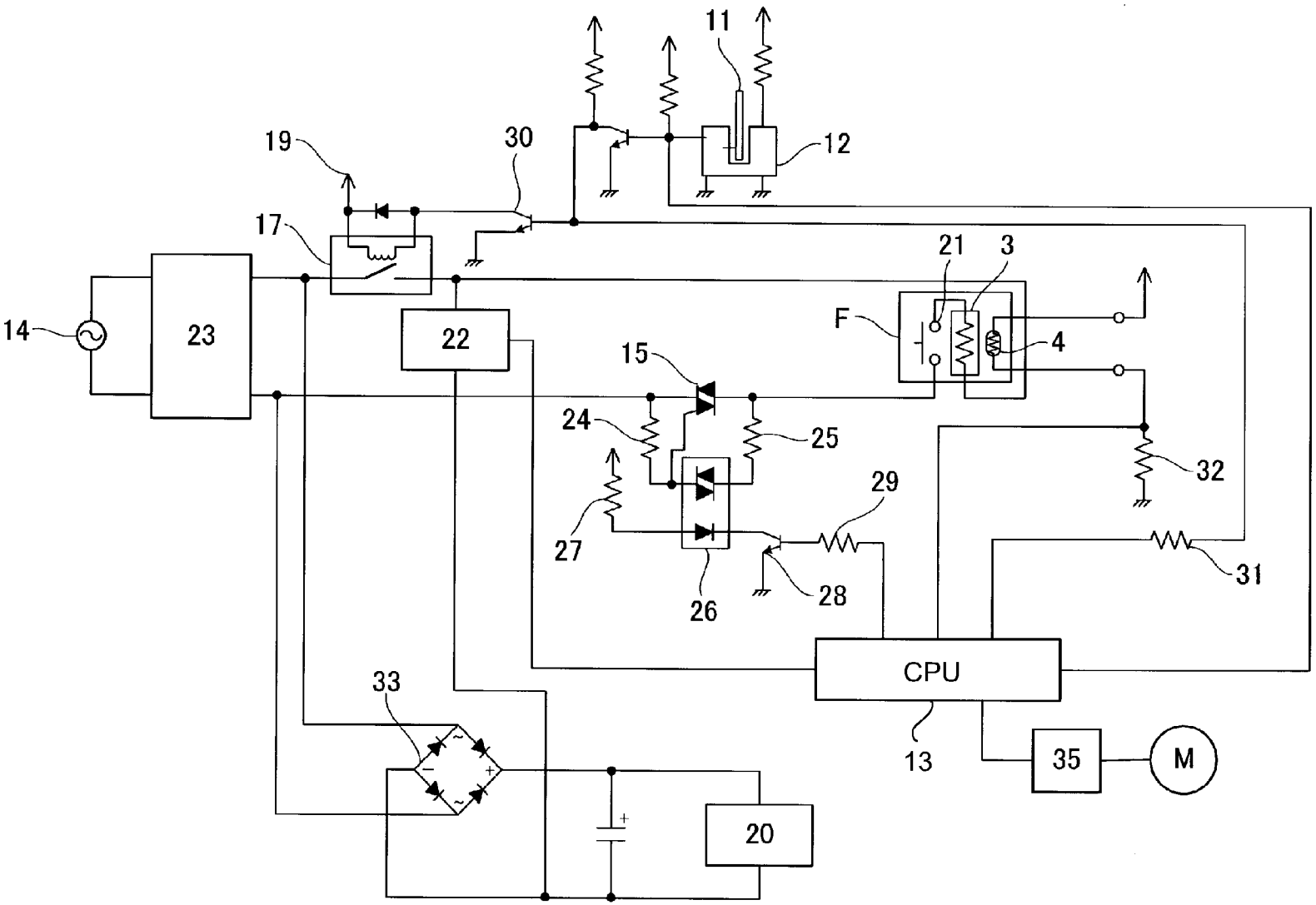
FIG. 3 is a drawing of the electric power supply circuit of the fixing portion in the first preferred embodiment.

FIG. 3 shows the electric power control circuit of the ceramic heater 3. In this embodiment, the ceramic heater 3 is made to generate heat, by the alternating electric power supplied to the heater 3 from a commercial electric power source 14 through an AC filter 23. The amount of electric power supplied to the ceramic heater 3 is controlled by the CPU 13 which controls a triac 15 (driving element) in response to the temperature level detected by the thermistor 4. Resistors 24 and 25 are bias resistors with which the triac 15 is provided.

A photo-triac coupler 26 is a device for ensuring that the primary and secondary sides remain isolated. Thus, the triac 15 is turned on (state in which it conducts electric power to heater), by supplying the light emitting diode of the photo-triac coupler 26 with electric power. A resistor 27 is for regulating the amount of the electric current flowing through the light emitting diode of the photo-triac coupler 26. The photo-triac coupler 26 is turned on or off by the photo-triac driving transistor 28. The photo-triac driving transistor 28 operates in response to the signals ON/OFF sent from the CPU 13 through the resistor 29.

The electric power supply from the commercial electric power source 14 can be blocked by a relay 17 (blocking means). The electric power supply from the commercial electric power supply source 14 can be conducted or blocked by turning on or off the relay 17 by the relay driving transistor 30. The relay driving transistor 30 operates in response to the signals ON/OFF inputted from the CPU 13 through a resistor 31.

As the image forming apparatus is instructed to start printing, the relay 17 is placed in the state in which the ceramic heater 3 can be supplied with electric power. The triac 15 is controlled to supply the ceramic heater 3 with electric power. Therefore, if a print start signal is inputted while the fixing portion F is in the state (second state) in which the pressure roller 2 is not kept pressed against the ceramic heater 3, like while the image forming apparatus in the sleep mode, first, the state of the fixation nip N is switched to the state (first state)

in which the pressure roller 2 is kept pressed against the ceramic heater 3, and then, the relay 17 is placed in the state in which it can conduct electricity. Thereafter, the controlling of the triac 15 is started. If the "blocking control" is executed to block the electric power supply to the ceramic heater 3 when the electric power source is off, the image forming apparatus is in the sleep mode, the paper jam or the like occurred, or in the like situation, the state of the triac 15 is switched to the state in which it does not conduct electricity, and then, the state of the relay 17 is switched to the state in which it does not conduct electricity.

The procedure for turning off the relay 17 is as follows: When the pressure roller 2 is not kept pressed against the ceramic heater 3, the photosensor 12 is blocked from light by the pressure removal sensor flag 11, as described above. Since the photosensor 12 is connected to the reference voltage through a pull-up resistor, a signal Hi, the voltage level of which is roughly equal to the reference voltage level, is outputted to the CPU 13. Then, as the CPU 13 detects this signal Hi, it turns off the relay driving transistor 30, putting thereby the relay 17 in the state in which it does not conduct electricity.

On the other hand, when the pressure roller 2 is kept pressed against the ceramic heater 3, the photosensor 12 is in the state in which its light path is not blocked, and in which a signal Lo, which is roughly equal in voltage level to the ground, is outputted from the photosensor 12. As the CPU 13 detects this signal Lo, it turns on the relay driver transistor 30, whereby the relay 17 is put in the state in which it conducts electricity.

The electric power supply path from the commercial electric power source 14 to the ceramic heater 3 branches before the relay 17 (commercial electric power side) into two lines which are in connection to a DC/DC converter 20 through a rectifier bridge 33, enabling the DC/DC converter 20 to provide 24 V and 3.3 V. The 24 V side of the converter 20 is used as the electric power source for the motors (which include motor M) of the main assembly of the image forming apparatus, and also, as the high voltage power source. The 3.3 V side of the converter 20 is used as the electric power source for the CPU 13 of the main assembly of the image forming apparatus, and the electric power source for the sensors (which include photosensor 12) of the main assembly of the image forming apparatus.

The power supply circuit of the fixing portion F is provided with a frequency detection circuit 22, which is connected between the aforementioned two branches from the commercial electric power line, on the heater side of the relay 17. One of the two terminals of the frequency detection circuit 22 is connected to a point between the relay 17 and triac 15, whereas the other is connected to the minus terminal of the rectifier bridge 33. Thus, the electric power from the commercial electric power source 14 is inputted into the frequency detection circuit 22 through the relay 17. Therefore, the frequency detection circuit 22 is capable of outputting electric power, the waveform of which is in synchronism with that of the commercial electric power source at least when the relay 17 is in the state in which it conducts electricity. The CPU 13 is capable of controlling (turning on or off) the triac 15 with the use of phase control or frequency control, by detecting the edge of the pulse which is outputted from the frequency detection circuit 22 and has the waveform ZEROX.

As described above, the fixing portion F is provided with the thermistor 4 for detecting the temperature of the ceramic heater 3. Further, a voltage dividing resistor 32 is in connection to the thermistor 4. Thus, the voltage obtained by dividing the reference voltage (Vref) by the thermistor 4 and voltage dividing resistor 32 is converted into DC voltage, and is inputted as a temperature detection signal (which hereafter will be referred to signal TH).

The temperature of the ceramic heater 3 is monitored by the CPU 13 based on the signal TH. That is, the CPU 13 calculates the amount by which electric power is to be supplied to the ceramic heater 3, by comparing the target temperature level set in the CPU, with the average temperature of the ceramic heater 3, which is obtained from the signal TH. Then, the amount of electric power obtained by the calculation is converted into a phase angle (phase control) or frequency (frequency control). Then, the CPU 13 controls the amount by which the electric power is to be supplied to the heater 3 by outputting signals ON to the triac driving transistor 28, based on the control requirements (phase angle or frequency). Further, the electric power supply line from the commercial electric power source 14 to the heater 3 has a thermo-switch 21 (thermal element) which responds to abnormal temperature increase. Thus, as the heater 3 abnormally increases in temperature, the thermo-switch 21 opens the electric power supply path in response to the heat from the heater 3.

(1-5: Protection Sequence)

If the above-described relay 17 and/or triac 15 malfunctions for some reason, it is liable that the electric power supply to the ceramic heater 3 cannot be blocked. Here, the "malfunction of the relay 17 and/or triac 15" means that the relay 15 and/or triac, which is ON, cannot be turned off, and therefore, the electric power supply to the heater 3 continues. When there is virtually no pressure between the ceramic heater 3 and pressure roller 2 in the fixation nip N, the area of contact between the heater 3 and fixation sleeve 1, and the area of contact between the fixation sleeve 1 and pressure roller 2, decrease in size (or become zero in size). Therefore, if the above mentioned malfunction(s) occurs, and therefore, the heater 3 continues to be supplied with electric power without the inputting of a print start command, it is difficult for the heat from the heater 3 to escape to the fixation sleeve 1 and/or pressure roller 2, and therefore, the temperature of the heater 3 increases very fast, making it possible that the temperature of the heater 3 reaches an abnormal level before the thermal element 21 responds.

In this embodiment, therefore, if the CPU 13 determines that there is virtually no pressure between the ceramic heater 3 and pressure roller, in the fixation nip N, and yet, the ceramic heater 3 is being supplied with electric power, the CPU 13 presses the pressure roller 2 against the heater 3 with the presence of the fixation sleeve 1 between the pressure roller 2 and heater 3. This is one of the characteristics of this embodiment. Thus, even if electric power is supplied to the ceramic heater 3 when there is virtually no pressure between the ceramic heater 3 and pressure roller 2, in the fixation nip N, the heat generated by the ceramic heater 3 can be transmitted not only to the fixation sleeve 1, but also, to the pressure roller 2, and therefore, the speed with which the temperature of the heater 3 increases is not excessively fast. Thus, it is ensured that there is a sufficient length of time for the thermo-switch 21 to respond, before the heater temperature reaches a level beyond which the heater 3 and/or fixation sleeve 1 are damaged. That is, it is possible to prevent the fixing portion F and adjacent components, in particular, the heater 3 and the fixation sleeve 1, from being damaged by the heat. Hereafter, this preventive sequence will be referred to as "protection sequence", which is described next.

Figure 4:
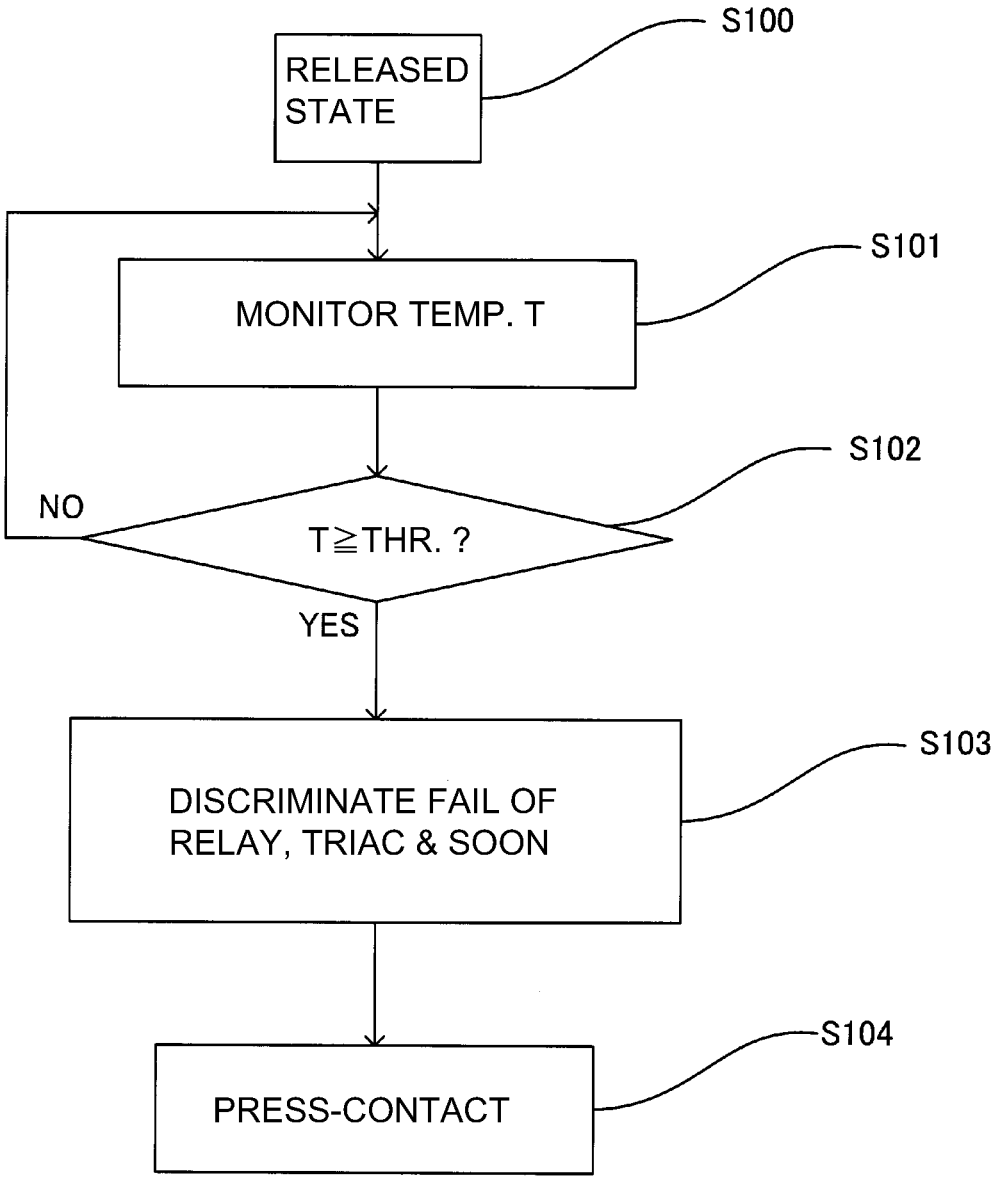
FIG. 4 is a flowchart of the control sequence in the first preferred embodiment.

FIG. 4 is the flowchart of the protection sequence. As the CPU 13 detects that the electric power source is off, the image forming apparatus is in the sleep mode, the image forming apparatus became jammed and/or in the like situation, the CPU 13 causes the pressure removal cam 10 to rotate, whereby the pressure roller 2 is moved away from the fixation sleeve 1. Thus, pressure is removed from between the ceramic heater 3 and pressure roller 2, in the fixing nip N (S100).

As pressure is removed from the fixation nip N, the signal Hi is outputted from the photosensor 12. Thus, the relay driving transistor 30 puts the relay 17 in the state in which the relay 17 does not conduct electricity. Further, the signal OFF has been inputted into the relay driving transistor 30 and the transistor 28 for driving the photo-triac 15, by the CPU 13. Therefore, the supply of electric power to the ceramic heater 3 is interrupted by the hardware (power blocking control). Incidentally, even after the removal of pressure from between the heater 3 and the pressure roller 2 in the fixation nip N, the CPU 13 continues to monitor the temperature T of the ceramic heater 3 through the thermistor 4 (S101).

While the CPU 13 monitors the temperature T of the ceramic heater 3, it compares the detected temperature T with the preset threshold value (200° C., for example), with preset intervals (S102). If the detected temperature T is no less than the threshold value, the CPU 13 determines that the relay 17 or relay driving transistor 30 is malfunctioning, or the triac 15 or photo-triac driving transistor 28 is malfunctioning, and therefore, electric power is being supplied to the ceramic heater 3 (S103). Then, the CPU presses the pressure roller 2 upon the fixation sleeve 1 with the use of the pressure application mechanism of the fixing portion F, by rotating the pressure removal cam 10 (S104). That is, the CPU 13 rotates the cam 10, using the timing with which the temperature T of the ceramic heater 3 detected by the thermistor 4 reaches the threshold value, as a trigger.

On the other hand, if the detected temperature T is no more than the threshold value, the CPU 13 determines that the relay 17 and triac 15 are in the normal condition, and in the states in which they do not conduct electricity. Then, it continues to monitor the temperature T of the ceramic heater 3 (S102-S101).

That is, with the execution of the protection sequence described above, even if the relay 17, triac 15, and/or the adjacent portions (driving transistors) of the circuit malfunction, and therefore, electric power continues to be supplied to the ceramic heater 3 while there is virtually no pressure between the ceramic heater 3 and the pressure roller 2 in the fixation nip N, the speed with which the temperature of the ceramic heater 3 increases is slowed down, and also, it is possible ensure that a time long enough for the thermo-switch 21 to respond is provided before the ceramic heater 3 and/or fixation sleeve 1 is thermally damaged. Therefore, it is possible to prevent the fixing portion F and its adjacencies from being thermally damaged. Further, it is desired that not only is the pressure roller 2 pressed upon the fixation sleeve 1, but also, it is rotated, because the rotation of the pressure roller 2 while it is in contact with the fixation sleeve 1 (while it is pressed against the ceramic heater 3) reduces the speed with which the temperature of the ceramic heater 3 increases.

Here, this embodiment was described with reference to a case in which the protection sequence is executed based on the comparison of the temperature of the ceramic heater 3 detected by the thermistor 4, with the preset threshold value. However, a step in which the threshold value is changed based on the temperature of the ceramic heater 3 detected by the thermistor 4 may be inserted into the above described protection sequence. Next, referring to FIG. 5, a protection sequence which includes a step in which the threshold value is varied is described.

Figure 5:
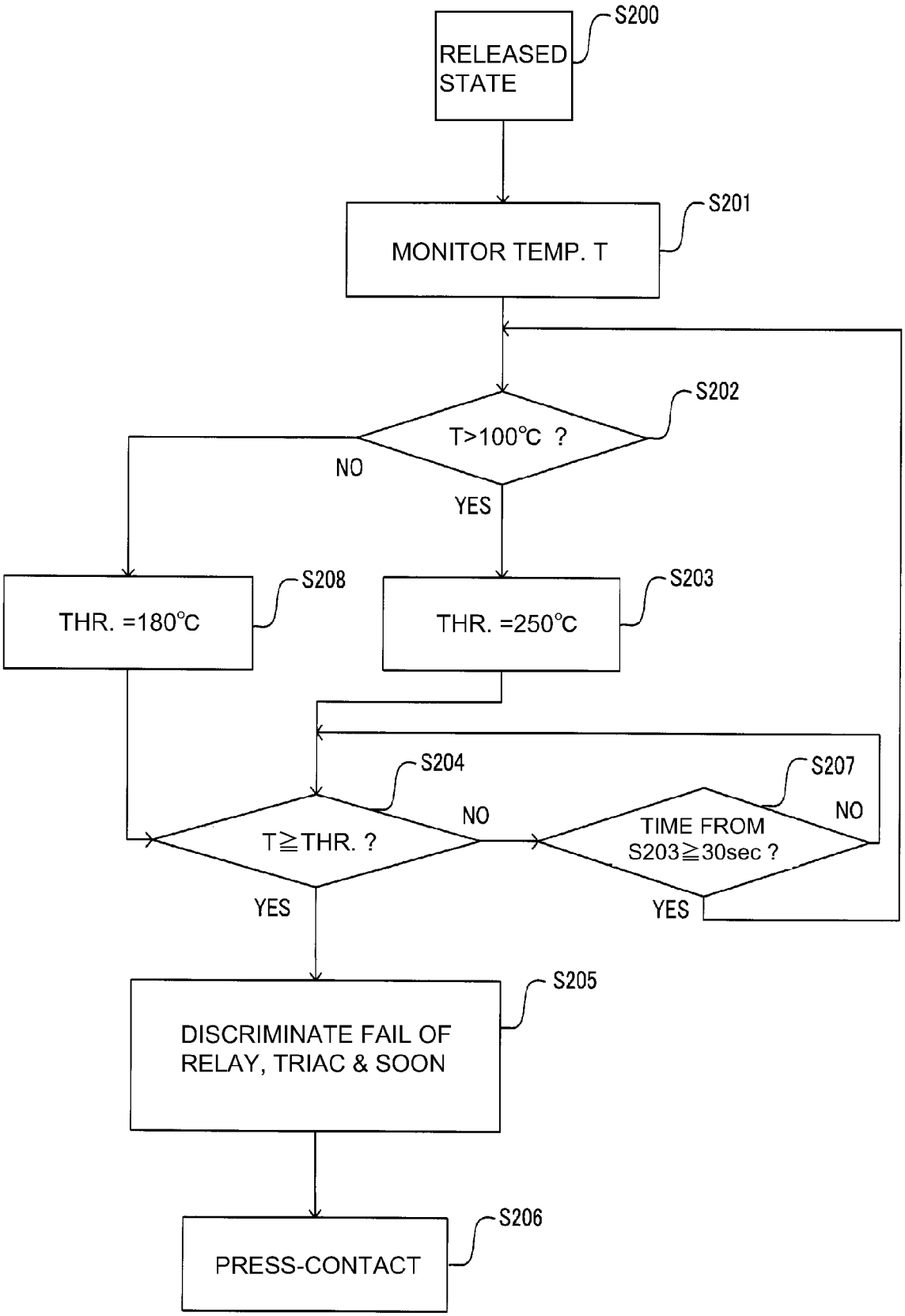
FIG. 5 is a flowchart of the control sequence in the first preferred embodiment.

In the case of the protection sequence in FIG. 5, it is determined, in S202, whether or not the temperature T of the ceramic heater 3 detected by the thermistor 4 is no less than 100° C. If it is no less than 100° C., the threshold value is set to 250° C., whereas if it is no more than 100° C., the threshold value is set to 180° C. (S203, S208). Thus, if it is right after the removal of pressure from between the ceramic heater 3 and the pressure roller 2 in the fixation nip N (right after stopping of driving of fixing portion F, that is, right after completion of fixation), the threshold value for the temperature of the ceramic heater 3 is likely to be set to 250° C., whereas if it is after the elapse of a certain length of time since the stopping of the driving of the fixing portion F, the threshold value is likely to be set to 180° C. With the threshold value changed as described above, it is possible to prevent the occurrence of such an unnatural operation that even though pressure has been removed from between the ceramic heater 3 and pressure roller 2 in the fixation nip N immediately after the ending of the fixing process (assuming that temperature of ceramic heater 3 detected immediately after removal of pressure was 200° C., for example), the pressure roller 2 is pressed again on the fixation sleeve 1, because the threshold value is 180° C. Further, with the temperature threshold value set as described above, whether or not the temperature of the ceramic heater 3 detected by the thermistor 4 is no less than the threshold value is determined based on the new threshold value (S204).

If the temperature of the ceramic heater 3 detected by the thermistor 4 is no less than the new threshold value, the CPU 13 determines that the relay 17 or relay driving transistor 30 is malfunctioning, or the triac 15 or photo-triac driving transistor 28 is malfunctioning, and therefore, electric power is being supplied to the ceramic heater 3 (S205). Then, the CPU puts the fixing portion F in the state in which the pressure roller 2 is kept pressed upon the fixation sleeve 1, with the use of the pressure application mechanism of the fixing portion F, by rotating the pressure removal cam 10 (S206).

On the other hand, if the CPU 13 determines, in S204, that the detected temperature T is no more than the threshold value, the CPU 13 returns to S202, and sets a new threshold value. However, if the interval between S203 and S204 is very short, it is possible that the malfunctioning may not be accurately detected. In this embodiment, therefore, the interval between S203 and S204 is set to no less than 30 seconds (S207).

(1-6: Effects of First Embodiment)

According to this embodiment, the malfunctioning of the relay 17 and adjacent circuitry, and the triac 15 and adjacent circuitry can be detected without requiring the provision of an image forming apparatus (fixing portion F) with an additional circuitry. Further, if it is detected that electric power is being supplied to the ceramic heater 3 even though there is virtually no pressure between the ceramic heater 3 and the pressure roller 2 in the fixation nip N, the pressure roller 2 is quickly pressed against the heater 3 with the presence of the fixation sleeve 1 between the pressure roller 2 and heater 3. Therefore, it is ensured that there is a sufficient length of time for the thermo-switch 21 to operate. Thus, the thermal damage to the fixing portion F can be minimized.

<Embodiment 2>

Figure 6:
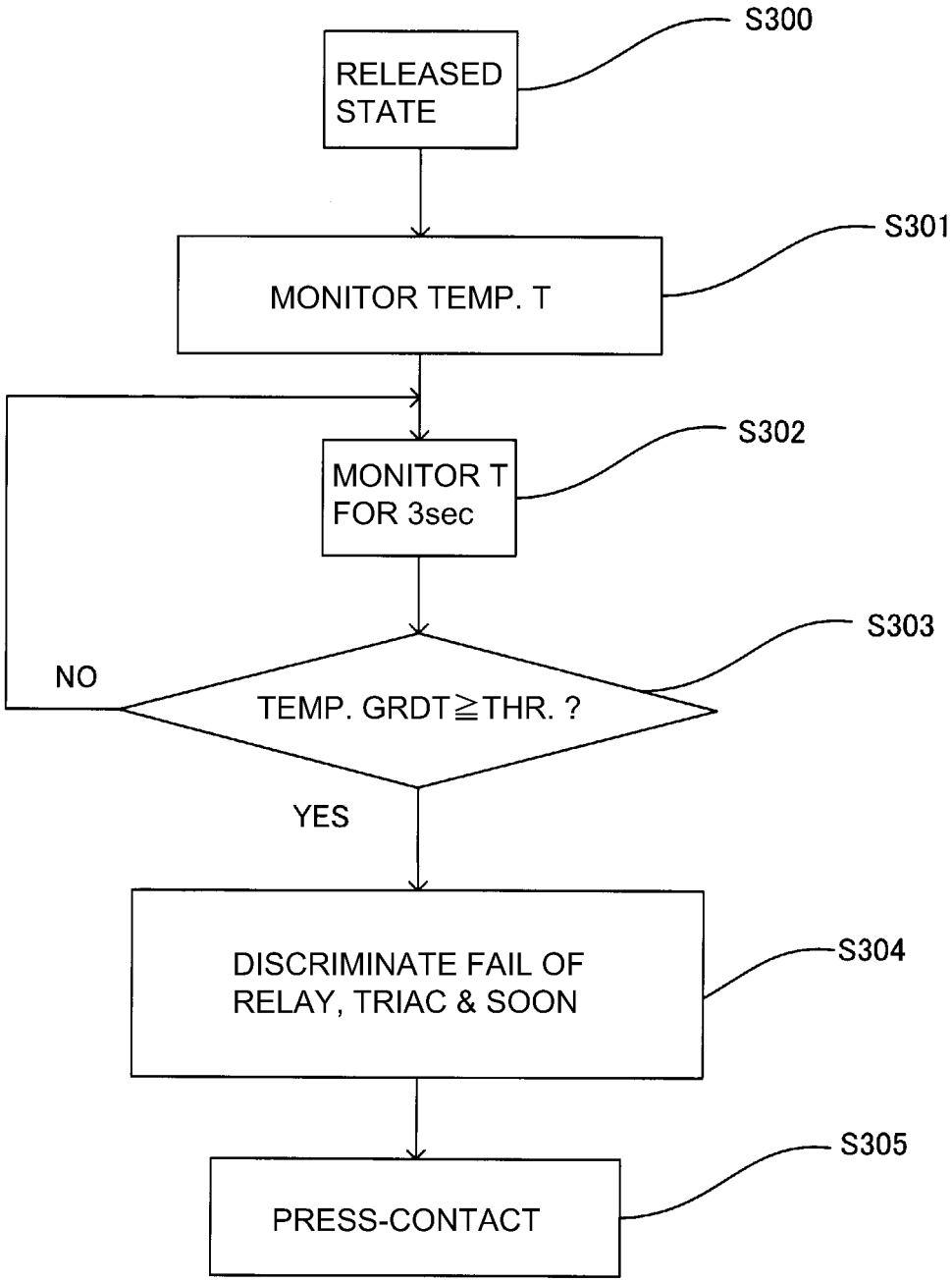
FIG. 6 is a flowchart of the control sequence in the second preferred embodiment.
Figure 7:
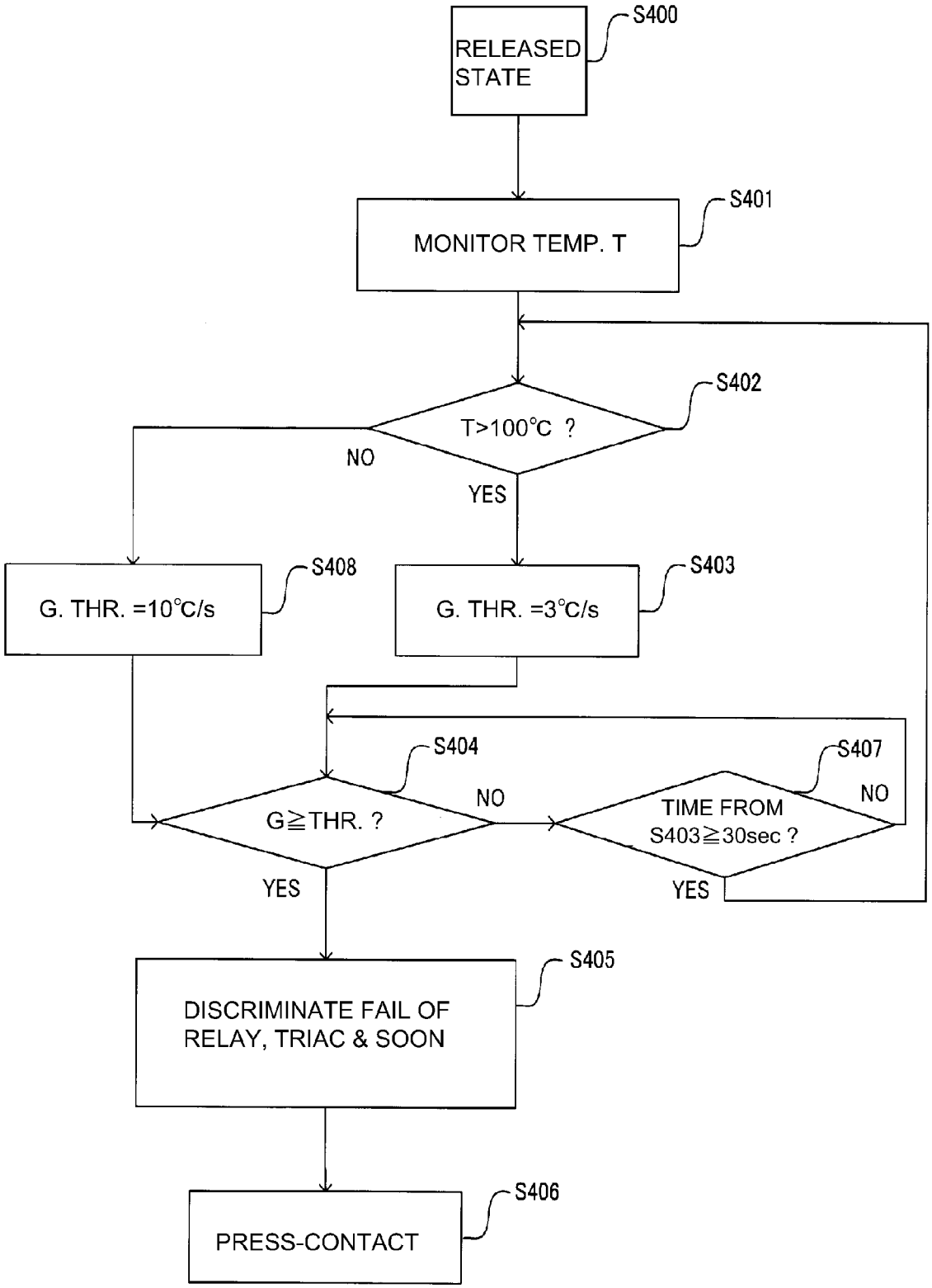
FIG. 7 is a flowchart of the control sequence in the second preferred embodiment.
Figure 8:
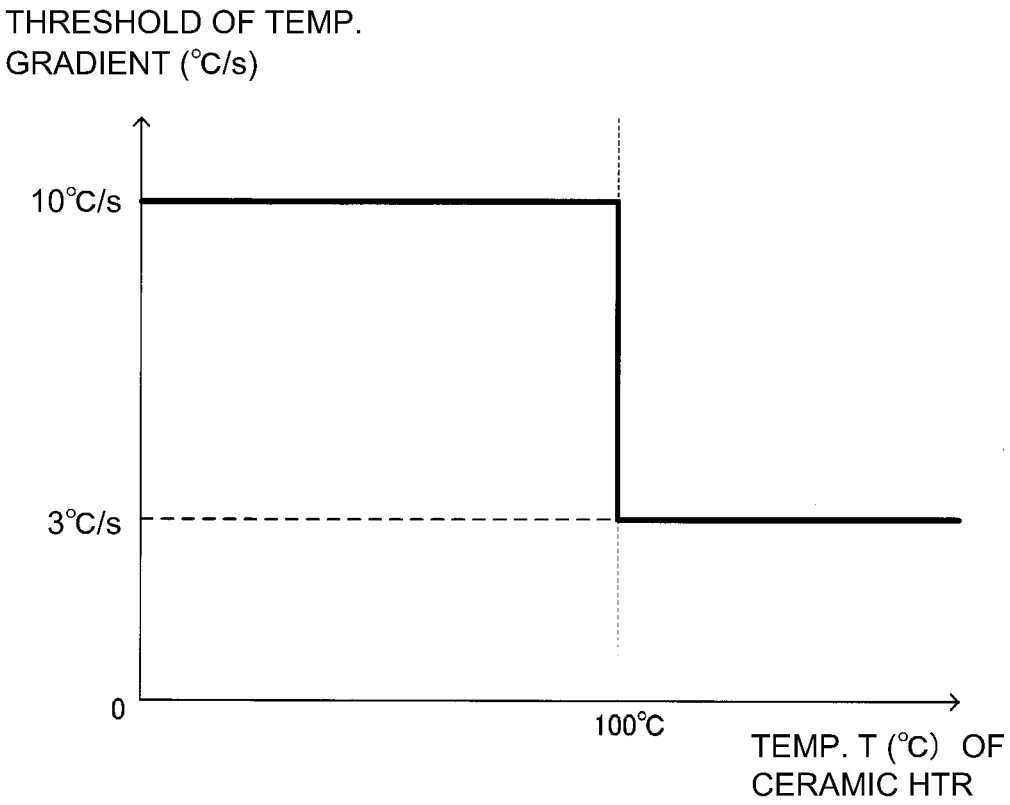
FIG. 8 is a graph which shows the threshold value of the temperature gradient in the second preferred embodiment.
Figure 9:
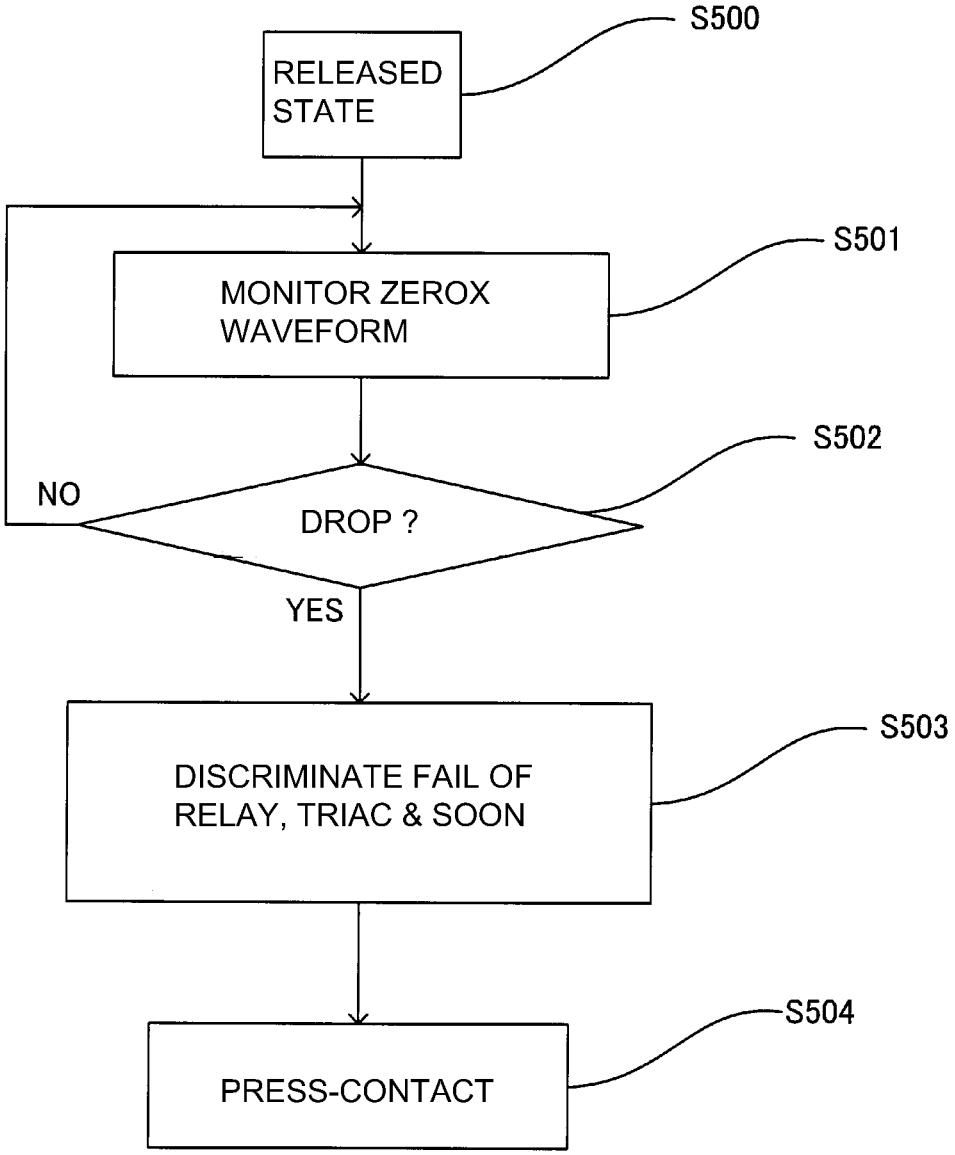
FIG. 9 is a flowchart of the control sequence in the third preferred embodiment.

Next, referring to FIGS. 6-8, the image forming apparatus in the second preferred embodiment of the present invention is described. The structure of the image forming apparatus, and the structure of the electric circuit of the fixing portion F, are the same as those in the first embodiment, and therefore, will not described here. That is, here, only the protection sequence in this embodiment will be described here.

(2-1: Protection Sequence)

In the case of the protection sequence in the first embodiment, if the detected temperature of the ceramic heater 3 is no less than the threshold value, the fixing portion F is put in the state in which the pressure roller 2 is kept pressed upon the fixation sleeve 1. In comparison, the protection sequence in this embodiment is characterized in that the gradient of the increase of the temperature of the ceramic heater 3 detected by the thermistor 4 (ratio of increase per unit length of time) is monitored, and the fixing portion F is put in the state in which the pressure roller 2 is kept pressed upon the fixation sleeve 1 if the temperature gradient becomes no less than a threshold value. Next, the protection sequence in this embodiment is described with reference to FIG. 6.

As the CPU detects that the electric power source is off, the image forming apparatus is in the sleep mode, the image forming apparatus is jammed, or in the like situation, it rotates the pressure removal cam 10, putting thereby the fixing portion F in the state in which the pressure roller 2 is not kept pressed upon the fixation sleeve 1 (S300).

As soon as the fixing portion F is put in the state in which the pressure roller 2 is not kept pressed upon the fixation sleeve 1, the signal Hi is outputted, whereby the relay 17 is put in the state in which it does not conduct electricity, by the relay driving transistor 30. Further, the signal OFF has been inputted into the relay driving transistor 30 and the transistor 28 for driving the photo-triac 15, by the CPU 13. Therefore, the supply of electric power to the ceramic heater 3 is interrupted by the hardware. Incidentally, even after the removal of pressure from between the ceramic heater 3 and pressure roller 2 in the fixation nip N, the CPU 13 continues to monitor the temperature T of the ceramic heater 3 through the thermistor 4 (S301).

Next, the CPU 13 monitors the temperature T of the ceramic heater 3 for a preset length of time (3 seconds in this embodiment), obtaining thereby the rate of temperature increase, that is, temperature gradient, of the ceramic heater 3. Then, it compares the rate with a preset threshold value (S302, S303). If the temperature gradient is no less than the threshold value, the CPU 13 determines that the relay 17 or relay driving transistor 30 is malfunctioning, or the triac 15 or photo-triac driving transistor 28 is malfunctioning, and therefore, electric power is being supplied to the ceramic heater 3 (S304). Then, the CPU puts the fixing portion F in the state in which the pressure roller 2 is kept pressed upon the fixation sleeve 1 with the use of the pressure application mechanism, by rotating the pressure removal cam 10 (S305). That is, the CPU 13 rotates the cam 10, using the timing with which the rate of increase of the temperature T of the ceramic heater 3 detected by the thermistor 4 reaches the threshold value, as a trigger.

On the other hand, if the temperature gradient is no more than the threshold value, the CPU 13 determines that the relay 17 and triac 15 are in the normal condition, and in the states in which they do not conduct electricity. Then, it continues to monitor the temperature T of the ceramic heater 3 (S303-S302). Incidentally, even if the temperature gradient is no more than the threshold value, it is possible that the relay 17 and/or triac 15 is malfunctioning. In such a case, however, the temperature increase is relatively gentle, and therefore, the entirety of the fixing portion F gradually warms up, making it easier for the temperature sensitive protective element (thermo-switch) to properly function.

With the execution of the protection sequence described above, even if the relay 17, triac 15, and/or the adjacent circuitry malfunctions, and therefore, electric power continues to be supplied to the ceramic heater 3 while the fixing portion F is in the state in which the pressure roller 2 is not kept pressed upon the fixation sleeve 1, the fixation sleeve 1 can be prevented from suddenly increasing in temperature, and therefore, not only the fixation sleeve 1, but also, the adjacent components, can be prevented from being thermally damaged.

Here, this embodiment was described with reference to a case in which the protection sequence is executed based on the comparison of the temperature gradient of the ceramic heater 3 detected by the thermistor 4, with the preset threshold value. However, a step in which the threshold value is changed based on the temperature gradient of the ceramic heater 3 detected by the thermistor 4 may be inserted into the protection sequence. Next, referring to FIG. 7, a protection sequence is described which includes a step in which the threshold value for the temperature gradient is changed.

In the case of the protection sequence in FIG. 7, it is determined whether or not the temperature T of the ceramic heater 3 detected by the thermistor 4 is no less than 100° C. in S402. If it is no less than 100° C., the threshold value for the temperature gradient is set to 3° C./s, whereas if it is no more than 100° C., the threshold value is set to 10° C. (S403, S408). That is, the CPU switches the threshold value for the temperature gradient at a preset temperature level (which is 100° C. in this embodiment). Incidentally, the threshold value for the temperature gradient is stored in the CPU 13 in advance.

For example, if it is immediately after the conveyance of a sheet of recording medium through the fixing portion F that the fixing portion F is put in the state in which the pressure roller 2 is not kept pressed upon the fixation sleeve 1, the temperature of the ceramic heater 3 detected by the thermistor 4 remains relatively high. In such a case, the threshold value for the temperature gradient, based on which the CPU 13 determines that the ceramic heater 3 is being supplied with electric power, is set low. After the elapse of a certain length of time, the temperature of the ceramic heater 3 detected by the thermistor 4 will have significantly fallen. Therefore, the threshold value for the temperature gradient, based on which the CPU 13 determines that the ceramic heater 3 is being supplied with electric power, is set higher. Then, whether or not the temperature gradient obtained by calculation is no less than the threshold value is determined based on the threshold value set as described above (S404).

If the temperature gradient is no less than the threshold value, the CPU 13 determines that the relay 17 or relay driving transistor 30 is malfunctioning, or the triac 15 or photo-triac driving transistor 28 is malfunctioning, and therefore, electric power is being supplied to the ceramic heater 3 (S405). Then, the CPU puts the fixing portion F in the state in which the pressure roller 2 is kept pressed upon the fixation sleeve 1 with the use of the pressure application mechanism of the fixing portion F, by rotating the pressure removal cam 10 (S406).

On the other hand, if the CPU determines, in S404, that the monitored temperature gradient is no more than the threshold value, the CPU 13 returns to S402, and sets a new threshold value. However, if the interval between S403 and S404 is very short, it is possible that the malfunctioning may not be accurately detected. In this embodiment, therefore, the interval between S403 and S404 is set to be no less than 30 seconds (S407).

As will be evident from the description of this embodiment given above, this embodiment is similar in effect as the first embodiment. Further, in the case of the first embodiment, the protective sequence is not executed unless the detected temperature of the ceramic heater 3 is not less than the threshold value. In comparison, in the case of this embodiment, the protective sequence is carried out based on the temperature gradient of the ceramic heater 3, regardless of the detected temperature of the ceramic heater 3. Therefore, the protection sequence is started before the temperature of the fixation sleeve 1 becomes excessively high.

<Embodiment 3>

Next, referring to FIGS. 9-12, the image forming apparatus in the third preferred embodiment of the present invention is described. Since the structure of the image forming apparatus, and the structure of the electric power supply circuit of the fixing portion F in this embodiment, are the same as those in the first embodiment, and therefore, are not described. That is, only the protection sequence is described here.

(3-1: Protection Sequence)

In the first and second preferred embodiments, the protection sequence is started as it is detected that because of the malfunctioning of the relay 17 or relay driving transistor 30, or the malfunctioning of the triac 15 or photo-triac driving transistor 28, the temperature of the ceramic heater 3 became abnormal. In comparison, this embodiment is characterized in that it is based on the detection of the type of the waveform ZEROX of the electric current outputted from the frequency detection circuit 22 that the operation for protecting the fixing portion F is started. Next, referring to FIG. 9, the protection sequence in this embodiment is described.

As the CPU 13 detects that the electric power source is off; the image forming apparatus is in the sleep mode, the image forming apparatus is jammed, or in the like situation, the CPU 13 puts the fixing portion F in the state in which the pressure roller 2 is not kept pressed upon the fixation sleeve 1, by rotating the pressure removal cam 10 (S500). Even after the removal of pressure from between the ceramic heater 3 and pressure roller 2 in the fixation nip N, the CPU 13 continues to monitor the waveform ZEROX of the output of the frequency detection circuit 22 (S501).

In order to determine whether or not the triac 15 and the relay 17 are in the state in which they do not conduct electricity, the CPU 13 determines whether or not the output of the frequency detection circuit 22 significantly falls, while monitoring the waveform ZEROX of the output of the frequency detection circuit 22 (S502). If the CPU 13 detects a significant amount of fall in the output of the frequency detection circuit 22 (in terms of waveform) for a preset length of time, it determines that the triac 15 and relay 17 are normally functioning, and in the state in which they do not conduct electricity. Then, it continues to monitor the waveform of the output of the frequency detection circuit 22 (S501).

If the CPU 13 detects the significant downward change in the output of the frequency detection circuit 22 in terms of the waveform ZEROX, it determines that the relay 17 or relay driving transistor 30 is malfunctioning, and the triac 15 or photo-triac driving transistor 28 is malfunctioning, and therefore, electric power is being supplied to the ceramic heater 3 (S503). Then, the CPU puts the fixing portion F in the state in which the pressure roller 2 is kept pressed upon the fixation sleeve 1 with the use of the pressure application mechanism of the fixing portion F, by rotating the pressure removal cam 10 (S504). Next, referring to FIGS. 10-12, how the malfunctioning of the relay 17, the relay driving transistor 30, the triac 15, and/or the photo-triac driving transistor 28 is detected in 5503 is described in detail.

Figure 10:
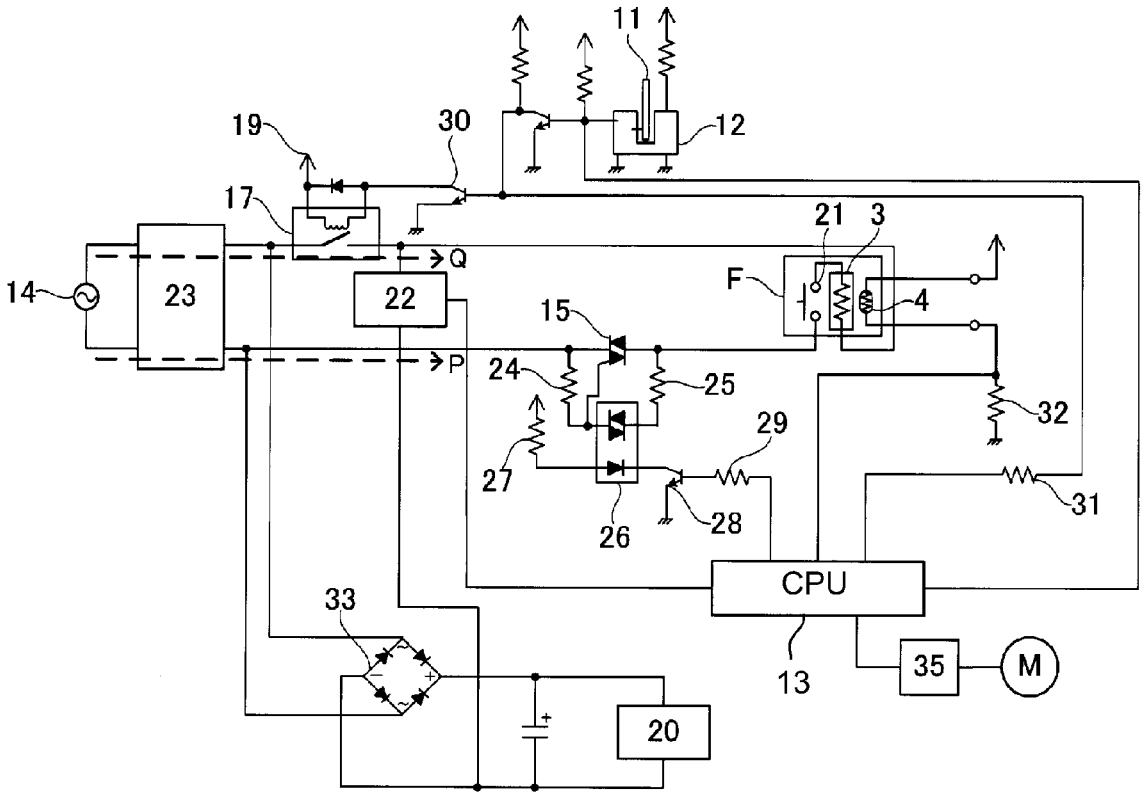
FIG. 10 is a combination of a drawing of the electric power supply circuit of the fixing portion, and a graph which shows the absence of the electric current having the waveform ZEROX after the ending of the fixing operation, when the fixing portion is in the normal condition.
Figure 10:
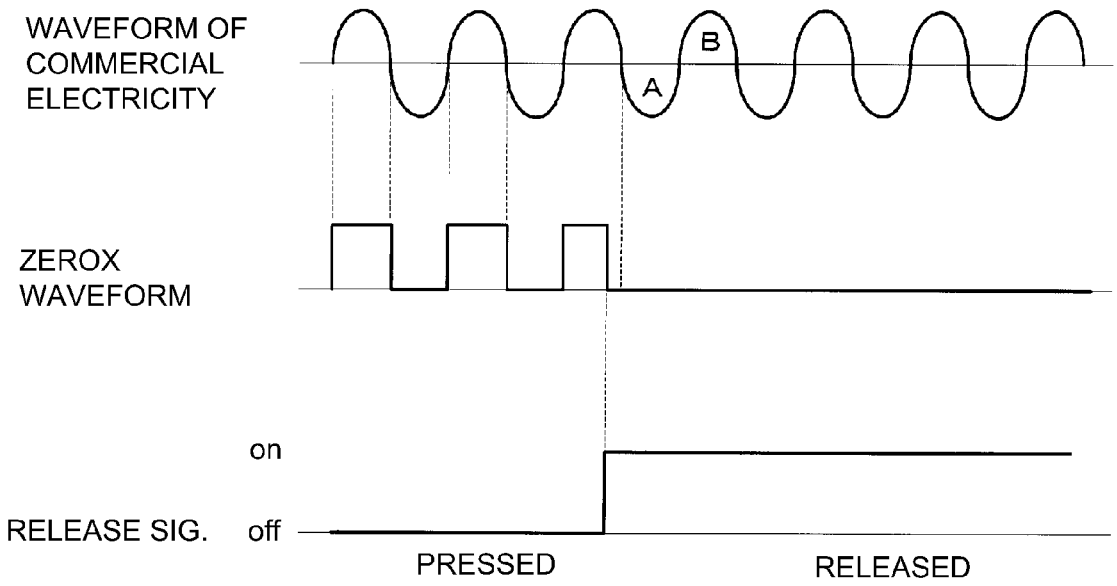

FIG. 10 shows the peripheral circuit which includes the relay 17, and the peripheral circuit which includes the triac 15, when both circuits are normal. In this case, after the CPU outputs a signal OFF to the triac 15, and then, outputs a signal OFF (pressure removal signal ON) to the relay 17 with the timing shown in FIG. 10 (switch state of fixing portion F from state in which pressure roller 2 is kept pressed upon fixation sleeve 1, to state in which pressure roller 2 is not kept pressed upon fixation sleeve 1), the electric current having the waveform ZEROX is not outputted, for the following reason.

That is, when the negative voltage portion (area A of waveform in FIG. 10) of the AC power is applied to the power supply circuit of the fixing portion F from the commercial electric power supply 14, electric current does not flow through the frequency detection circuit 22 because the triac 15 is in the state in which it does not conduct electricity (dotted line P in drawing). On the other hand, when the positive voltage portion (area B in drawing) is applied to the power supply circuit of the fixing portion F, no electric current flows through the frequency detection circuit 22, because the relay 17 is in the state in which it does not conduct electricity (dotted line Q in drawing). In other words, no electric current flows through the frequency detection circuit 22. Therefore, there is no electric current having the waveform ZEROX.

Figure 11:
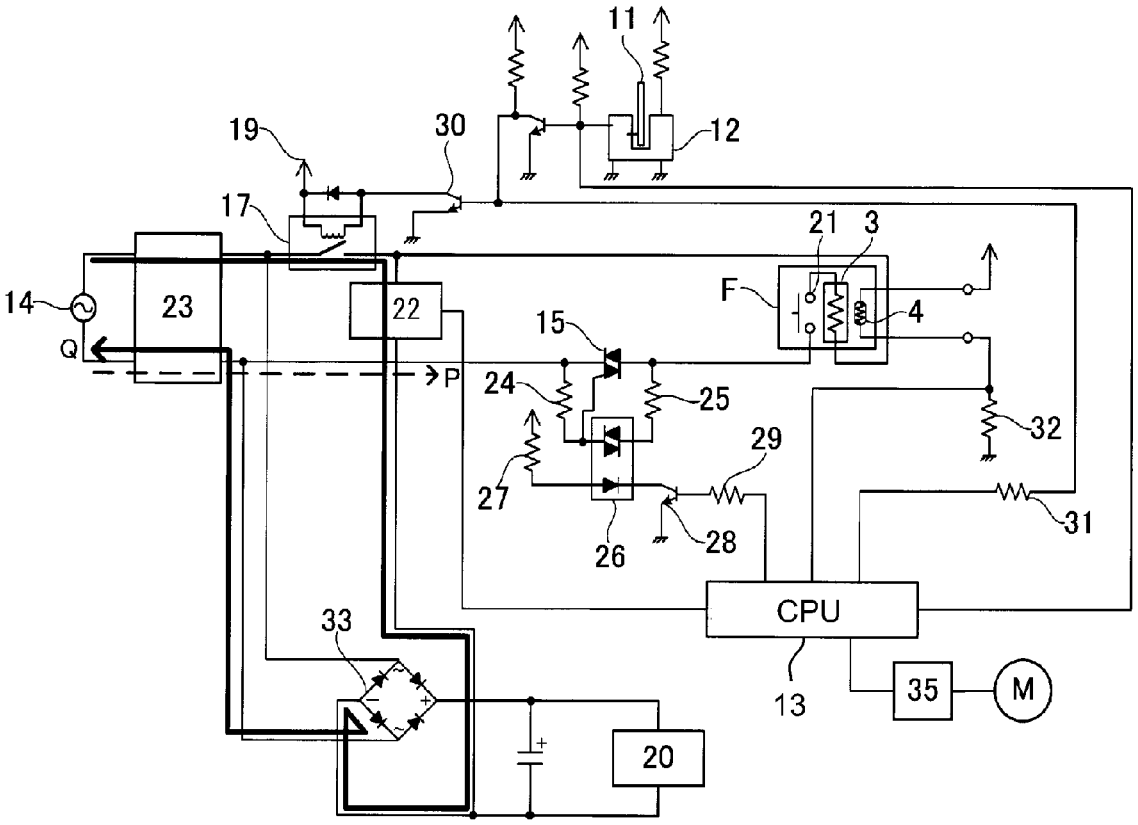
FIG. 11 is a combination of a drawing of the electric power supply circuit of the fixing portion, and a graph which shows the waveform ZEROX of the electric current which flows through the electric circuit when the means for blocking the transmission of electric power supply is malfunctioning.
Figure 11:
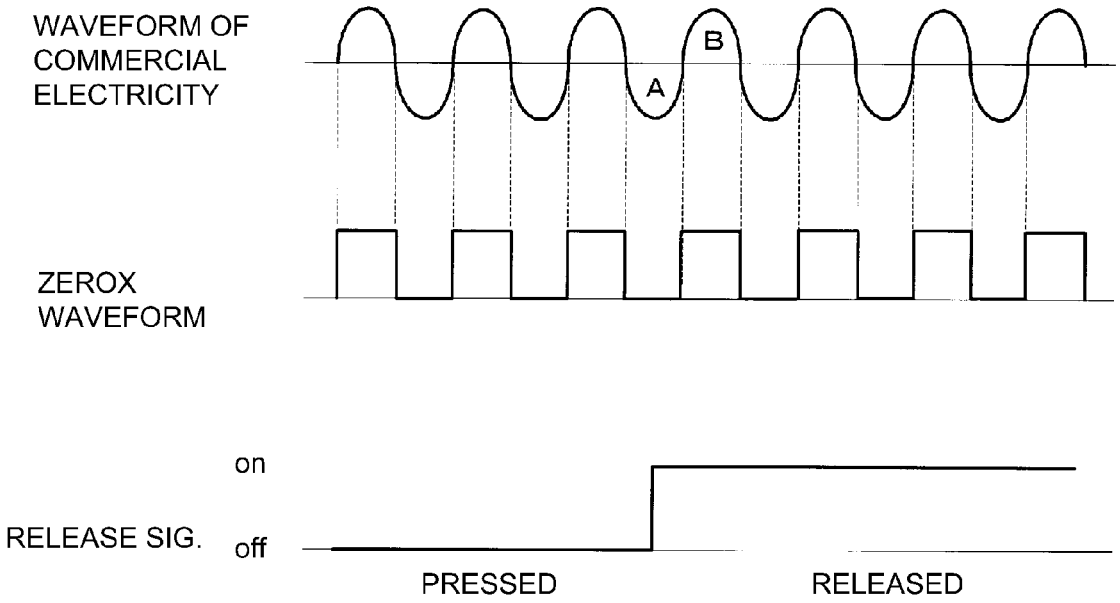

FIG. 11 represents a case in which the relay 17 or the relay driving transistor 30 is malfunctioning. In this case, after the CPU 13 outputs a signal OFF to the triac 15, and then, outputs a signal OFF to the relay 17 (pressure removal signal ON) with the timing shown in FIG. 11 (state of fixing portion F is switched from state in which pressure roller 2 is kept pressed upon fixation sleeve 1, to state in which pressure roller 2 is not kept pressed upon fixation sleeve 1), such electric current that has the waveform ZEROX shown in FIG. 12 is detected, for the following reason.

That is, when the negative portion (area A in FIG. 11) of the electric power which is supplied from the commercial electric power source 14 and has the waveform (alternating waveform) shown in FIG. 11 is applied to the electric power circuit of the fixing portion F, no electric current flows through the frequency detection circuit 22 (dotted line P in FIG. 11), because the triac 15 is in the state in which it does not conduct electricity. On the other hand, when the positive portion of the voltage (area B in FIG. 11) is applied, electric current flows the frequency detection circuit 22 by way of the relay 17, frequency detection circuit 22, rectifying bridge 33, and commercial electric power source 14 in the listed order (solid line Q in FIG. 11). Thus, such electric current that as the waveform ZEROX shown in FIG. 11 is detected.

Figure 12:
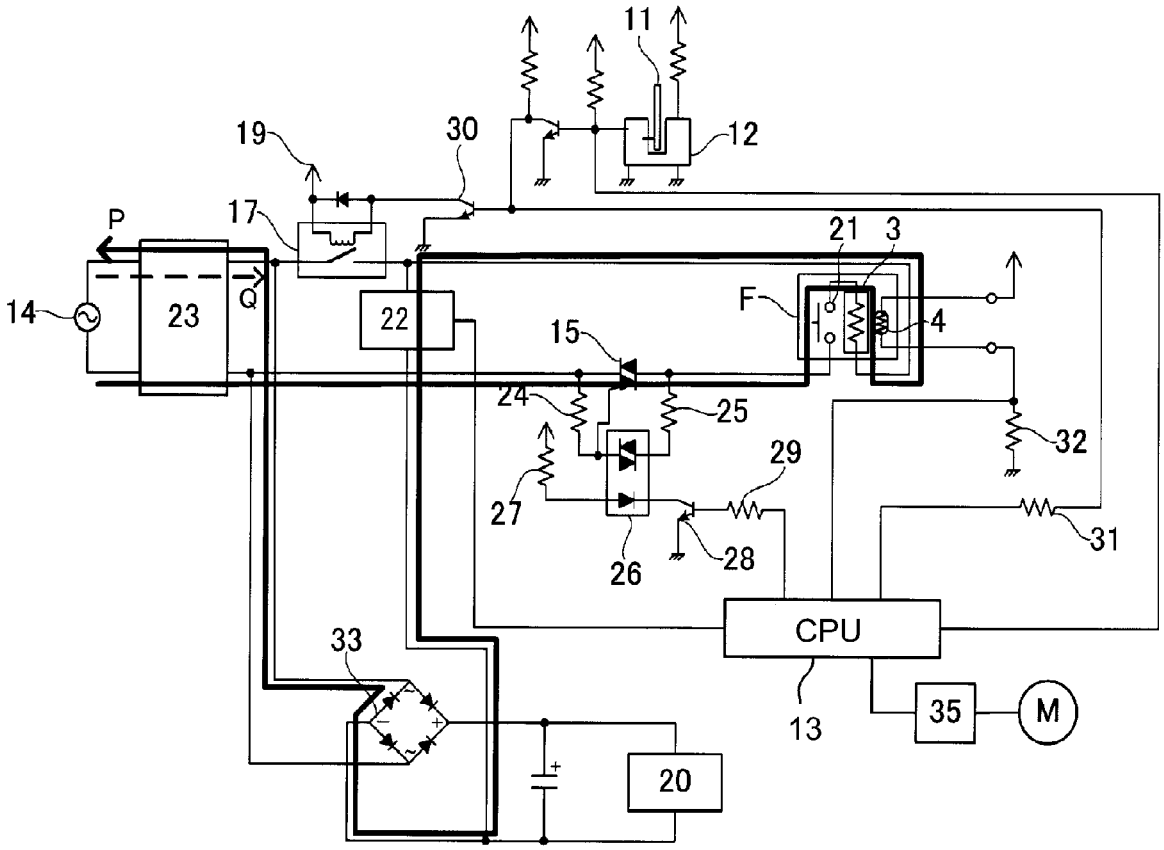
FIG. 12 is a combination of a drawing of the electric power supply circuit of the fixing portion, and a graph which shows the waveform ZEROX of the electric current which flows through the electric circuit when the power supply controlling means is malfunctioning.
Figure 12:
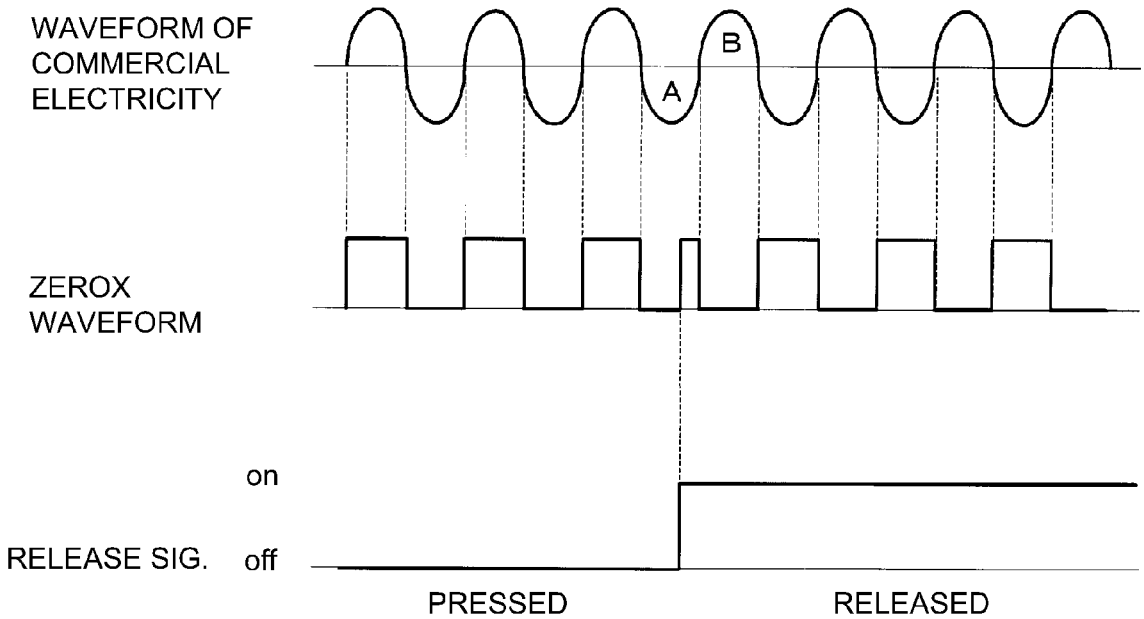

FIG. 12 represents a case in which the triac 15 or the photo-triac driving transistor 28 is malfunctioning. After the CPU 13 outputs a signal OFF to the triac 15, and then, outputs a signal OFF to the relay 17 (pressure removal signal ON: switch state of fixing portion F from state in which pressure roller 2 is kept pressed upon fixation sleeve 1, to state in which pressure roller 2 is not kept pressed upon fixation sleeve 1), such electric current that has the waveform ZEROX shown in FIG. 12 is detected, for the following reason.

That is, the electric power supplied by the commercial electric power is an AC power, and therefore, its waveform is as shown by the drawing. Thus, when the negative voltage portion (area A in drawing) of the electric power is supplied, electric current flows through the electric power circuit 22 by way of the triac 15, the fixation heater 3, the frequency detection circuit 22, the rectifying bridge 33, and the commercial electric power source 14 in the listed order (solid line P in drawing). On the other hand, when the positive portion (area B in drawing) of the electric power is supplied, no electric current flow through the frequency detection circuit 22, because the relay 17 is in the state in which it does not conducts electricity (dotted line Q in drawing). Thus, such electric current that has the waveform ZEROX shown in FIG. 12 is detected.

As will be evident from the description of this embodiment given above, when one of the peripheral circuit which includes the relay 17, and the peripheral circuit which includes the triac 15, is malfunctioning, that is, when the ceramic heater 3 is being provided with electric power, the detected current has a waveform ZEROX even after the CPU 13 outputted a signal OFF to the relay 17. Therefore, no matter which of the two is malfunctioning, the anomaly can be detected based on the waveform of the electric current.

In this embodiment, one of the terminals of the frequency detection circuit 22 is in connection to a point between the relay 17 and ceramic heater 3, and the other is in connection to the minus terminal of the rectifying bride 33. Thus, the CPU 13 monitors the waveform (ZEROX) of the output of the frequency detection circuit 22 to detect whether or not the relay 17 or triac 15 is in the state in which they conduct electricity or in the state in which they do not conduct electricity. However, the above-described control can be carried out by providing the fixing portion F with a means for detecting whether or not electric current is flowing through the relay 17 or triac 15.

For example, the fixing portion F may be structured as follows: As electric current having the waveform ZEROX is detected, a condenser is charged through a diode, and the signal outputted as the voltage of the condenser reaches a preset level, is compared by a comparator or the like, with the signal OFF outputted to the relay 17. Then, whether or not the relay 17 or triac 15 is malfunctioning is determined based on the output of the comparator or the like.

As will be evident from the description of this embodiment, the effects of this embodiment are the same as those of the first and second embodiments. Further, in the first and second embodiments, the protection sequence is started based on the detected thermal state of the ceramic heater 3. In this embodiment, however, the protection sequence is started the moment the signal having the waveform ZEROX is detected. Therefore, this embodiment can significantly reduce the length of time electric power continues to be supplied to the ceramic heater 3 while the fixing portion F is in the abnormal condition.

<Miscellaneous Embodiments>

In the first to third embodiments, the protection sequence was ended after the fixing portion F was put in the state in which the pressure roller 2 was kept pressed upon the fixation sleeve 1. However, a step in which the pressure roller 2, and the fixation sleeve 1, which is circularly moved by the rotation of the pressure roller 2, are rotated with the use of the motor M for a preset length of time, may be added after the step in which the fixing portion F is put in the state in which the pressure roller 2 is kept pressed upon the fixation sleeve 1, With the addition of this step, it is possible to further reduce the speed with which the fixation sleeve 1 and the pressure roller 2 increase in temperature, and therefore, it is possible to more effectively prevent the damage to the fixing portion F.

Further, a current transformer (current detecting means) capable of detecting the electric current which flows through the ceramic heater 3 may be placed between the commercial electric power source 14 and the ceramic heater 3. With this setup, if electric current, the amount of which is greater than the threshold value set by the CPU 13 while there is virtually no pressure between the ceramic heater 3 and pressure roller 2 in the fixing portion F, it is possible to determine that the ceramic heater 3 is being supplied with electric power, and then, to place the pressure roller 2 upon the fixation sleeve 1 with the use of the pressure applying mechanism of the fixing portion F.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 105721/2010 filed Apr. 30, 2010 which is hereby incorporated by reference.

What is claimed is:

1. An image forming apparatus comprising:

a fixing portion configured to fix an image formed on a recording material, said fixing portion including an endless belt, a heater contacted to an inner surface of said endless belt, a pressing member configured to form a fixing nip with said heater through said endless belt, and a temperature detection element configured to detect a temperature of said heater;

a central processing unit configured to control an operation of the apparatus; and a switching mechanism configured to switch a state of said fixing nip between a first state in which pressure at the time of a fixing operation is applied in the fixing nip and a second state in which the pressure at the time of the fixing operation is not applied in the fixing nip, wherein when the temperature detected by said temperature detection element is no less than a threshold value in the second state despite the lack of a signal produced by the central processing unit to energize said heater, the central processing unit controls said switching mechanism to switch the state of said fixing nip from the second state to the first state, and wherein if the temperature detected by said temperature detection element immediately after switching the state of said fixing nip from the first state to the second state is no less than a predetermined value, the threshold value is set to a first value, and if the temperature detected by said temperature detection element immediately after switching the state of said fixing nip from the first state to the second state is no more than the predetermined value, the threshold value is set to a second value lower than the first value.

2. The image forming apparatus according to claim 1, wherein said fixing portion includes a thermosensitive element, responsive to abnormal temperature rise of said heater, configured to open an electric power supply path to said heater.

* * * * *